United States Patent [19]

Matsuda et al.

[11] Patent Number: 4,775,658

[45] Date of Patent: Oct. 4, 1988

[54] DYE-RECEIVING SHEETS FOR THERMAL TRANSFER PRINTING COMPRISING A DYE-RECEIVING LAYER CONTAINING SILANE-COUPLED NETWORK STRUCTURES

[75] Inventors: Hiromu Matsuda, Osaka; Nobuyoshi Taguchi; Akihiro Imai, both of Ikoma, all of Japan

[73] Assignee: Matsushita Electric Industrial Co., Ltd., Osaka, Japan

[21] Appl. No.: 101,029

[22] Filed: Sep. 25, 1987

[30] Foreign Application Priority Data

Sep. 26, 1986 [JP] Japan ..... 61-229026

[51] Int. Cl.[4] ..... B41M 5/035; B41M 5/26

[52] U.S. Cl. ..... 503/227; 8/471; 427/146; 427/180; 427/199; 427/204; 427/256

[58] Field of Search ..... 8/470, 471; 427/146, 427/180, 199, 204, 256; 428/195, 331, 421, 422, 447, 480, 913, 914; 430/200, 201, 945; 503/227

[56] References Cited

U.S. PATENT DOCUMENTS 4,490,434 12/1984 Oshima et al. ..... 8/471

FOREIGN PATENT DOCUMENTS 1027292 2/1986 Japan ..... 503/227

1199997 9/1986 Japan ..... 503/227

*Primary Examiner*—Bruce H. Hess

*Attorney, Agent, or Firm*—Lowe, Price, LeBlanc, Becker & Shur

[57] ABSTRACT

A dye-receiving sheet for thermal transfer printing which is used in combination with a dye transfer sheet and comprises a substrate and a dye-receiving layer formed on one side of the substrate. The dye-receiving layer is made of a dye-receiving resin matrix dispersing a mixture of a silane copolymer and colloidal silica particles which form strong network structures through silane coupling, and a releasing surface active agent.

20 Claims, No Drawings

DYE-RECEIVING SHEETS FOR THERMAL TRANSFER PRINTING COMPRISING A DYE-RECEIVING LAYER CONTAINING SILANE-COUPLED NETWORK STRUCTURES

BACKGROUND OF THE INVENTION

1. Field of the Invention

This invention relates to dye-receiving sheets for thermal transfer printing which are used in combination with a transfer sheet using sublimable dyes.

2. Description of the Prior Art

Dye-receiving sheets of the type to which the present invention is directed are known, for example, in Japanese Laid-open Patent Application No. 59-133098. This patent application describes a sublimable dye-receiving layer which is made of a ultrafine oxide powder as a dye adsorber and a polymer material for dispersing the powder.

Japanese Laid-open Patent Application No. 59-215398 describes a dye-receiving sheet having a coating or impregnated layer of a thermoplastic polyester resin and a crosslinked polyester resin.

The fundamental characteristics required for an image or dye-receiving sheet for thermal transfer printing processes using sublimable dyes include good dye receptivity, anti-blocking properties against a dye-bearing layer of a dye transfer sheet, e.g. anti-fusing properties and a lowering in releasability both at the time of thermal printing, and weatherability sufficient to maintain a stable dye-receiving state. In addition, since the sheet is an article of consumption, production costs should be low.

In order to ensure good dye receptivity and weatherability, the dye-receiving layer should basically contain a large proportion of a dye-receiving resin capable of stably receiving a sublimable dye and readily dispersing the dye. Such dye-receiving resins are usually thermoplastic resins, typical of which are saturated linear polyester resins. However, if these dye-receiving resins are used singly as the dye-receiving layer, a good heat resistance and releasability cannot be obtained, or good anti-blocking properties cannot be ensured. To avoid this, usual practice is (1) to add heat-resistant fine particles and a lubricant or release agent to the dye-receiving resin so as to impart a high heat resistance and releasability, or (2) to use a crosslinking resin component as part of the dye-receiving resin and cure this component after formation of a dye-receiving layer by which the layer is imparted with a good heat resistance and releasability. The sheet described in the Japanese Laid-open Patent Application No. 59-122098 is of the former type and the sheet set forth in the Japanese Laid-open Patent Application No. 59-215398 is of the latter type.

In the above class (1), large amounts of heat-resistant fine particles or a lubricant or releasing agent are necessary for imparting antiblocking properties of a level sufficient for practical use. These ingredients are generally used in amounts not less than 50 wt% of the total solid components in the dye-receiving layer. This means a reduction in amount of the resin which actually receives dye molecules. The resultant layer becomes poorer in color fastness to light and color fastness in the dark than a case where a larger amount of the resin is used, with a poorer sensitivity to color fomation. Moreover, the fine particles used in large amounts worsen the transparency and gloss of the dye-receiving layer, thus impeding the brightness of a color-developed image.

In the second class, the problems involved in the first class can be solved, but when the crosslinking density increases and the heat resistance of the dye-receiving layer is thus improved so as to enhance the anti-blocking properties, the diffusability of dye molecules decreases with a lowering of chromophoric sensitivity. Moreover, the curing process is an additional step by which the productivity lowers with respect to the formation of the dye-receiving layer.

SUMMARY OF THE INVENTION

It is an object of the invention to provide a dye-receiving sheet for thermal transfer printing which is used in combination with a sublimable dye transfer sheet and can receive dye molecules from the transfer sheet in an imagewise pattern by application of a thermal head or a laser beam or by electric heating and which can overcome the drawbacks of the prior art.

It is another object of the invention to provide a dye-receiving sheet for thermal transfer printing which is rarely antiblocked with a dye layer of a dye transfer sheet when contacted and which has good dye receptivity and good weatherability.

It is a further object of the invention to provide a dye-receiving sheet for thermal transfer printing which can be made in high productivity.

The above objects can be achieved, according to the invention, by a dye-receiving sheet for thermal transfer printing which is used in combination with a dye transfer sheet having a sublimable dye layer and which comprises a substrate and a dye-receiving layer formed on the substrate and comprised of a dye-receiving resin and a releasing agent. The present invention is characterized in that the dye-receiving layer further comprises a mixture of a silane copolymer and colloidal silica particles, which is in the form of a silane-coupled product having strong network structures of the silane copolymer and the colloidal silica particles. Because of the dispersion of the specific type of network structure in the dye-receiving layer, the properties and particularly, the heat resistance, required for the dye-receiving layer are significantly improved. In a preferred embodiment, the dye-receiving layer is formed by a specific process. The process comprises applying, onto a substrate, an aqueous composition comprising a dye-receiving resin soluble or dispersable in water, an aqueous dispersion of colloidal silica particles in an emulsion of a silane copolymer, and a water-soluble, releasing agent, and drying the applied composition to form a dye-receiving layer on the substrate. During the drying, the emulsion breaks the emulsion breaks and silane coupling takes place between the emulsion particles of the silane copolymer and between the emulsion particles and the colloidal silica particles thereby forming strong network structures in the dye-receiving layer.

DETAILED DESCRIPTION AND EMBODIMENTS OF THE INVENTION

The dye-receiving resins are those resins which can readily disperse a sublimable dye and can stably receive the dye. In general, thermoplastic resins are used for this purpose, typical of which are saturated linear polyester resins, epoxy resins, cellulose acetate resins, polyamide resins and the like. The dye-receiving resins are known in the art and such known resins may be used in the practice of the invention. These resins are used as a matrix of the dye-receiving layer of the dye-receiving sheet of the present invention.

The releasing agents are contained in order to prevent fusion with a sublimable dye layer of a dye transfer sheet and to allow easy separation from the dye layer when heated in contact with the dye layer for printing. These releasing agents should preferably be soluble in water for reasons described hereinafter. Examples of the releasing agents include various types of surface active agents such as silicone surface active agents, fluorine-containing surface active agents and other organic surface active agents. Preferably, silicone or fluorine-containing surface active agents are used because of the high surface activity and a good releasing performance at high temperatures. Various silicone surface active agents are known and are preferably those agents having dimethylsilicone unit or groups as a hydrophobic group and polyether units as a hydrophilic group. The fluorine-containing surface active agents are preferably those agents having perfluoroalkyl groups as a hydrophobic group and polyether units as a hydrophilic group. These agents are well known in the art and are not further described herein.

In the dye-receiving layer of the dye-receiving sheet according to the invention, it is essential to incorporate a mixture of a silane copolymer and colloidal silica particles, which is present in the layer in the form of a silane-coupled product having strong network structures formed through silane coupling of the silane copolymer and the colloidal silica particles.

The silane copolymers having silane units in the molecule are dispersed in the resin matrix along with colloidal silica particles. In the resin matrix, the silane copolymer and the silica particles form strong network structures through silane coupling. For the formation of the strong network structures, an aqueous emulsion of the silane copolymer, in which the colloidal silica particles are contained, is used. Upon breakage of the emulsion such as by drying, the silane coupling takes place between the emulsion particles of the copolymer and also between the emulsion particles and the silica particles to form the network structures in the resin matrix.

The silane copolymers useful in the present invention should preferably have hydrolyzable groups which are able to react with the colloidal silica. Examples of such groups include —OR, —OCOR in which each R represents an alkyl group having from 1 or 2 carbon atoms, or a halogen such as Cl. The silane copolymers may be copolymers of vinyl silane monomers and acrylic monomers. These copolymers can be prepared by emulsion copolymerization of these monomers in the presence of anionic or nonionic surface active agents. Examples of the surface active agents include alkali salts of alkylallylsulfosuccinates, sodium(glycerine n-alkenylsuccinoylglycerine)borate, and the like. Specific and preferable examples of these copolymers include copolymers of vinyl trimethoxysilane/butyl acrylate/methyl methacrylate, vinyl triethoxysilane/2-ethylhexyl acrylate/methyl methacrylate, vinyl methoxysilane/butyl acrylate/styrene, vinyl triacetoxysilane/butyl acrylate/methyl acrylate and the like. The content of the silane monomer to the total amount of the acrylic monomers used is generally in the range of from 1 to 10 parts by weight per 100 parts by weight of the total acrylic monomers.

The colloidal silica may be a sol of ultrafine silica powder having a primary particle size of from 5 to 50 mμ. The colloidal silica is added to the silane copolymer in an amount of from 1 to 200 parts by weight per 100 parts by weight of the solid copolymer.

As described above, the dye-receiving layer of the sheet according to the invention is comprised, as essential components, of a dye-receiving resin, a silane copolymer and colloidal silica in the form of a silane-coupled product having strong network structures, and a releasing agent. The dye-receiving resin is used in amounts sufficient to form a continuous phase in the dye-receiving layer, and the silane-coupled product having strong network structures can impart a good heat resistance when used in a relatively small amount. Because the releasing agent tend to locally concentrate or segregate in the surface of the dye-receiving layer during drying for forming the dye-receiving layer, a small amount is sufficient for imparting the releasability to the layer. In general, the amounts of these three ingredients are not critical and may be arbitrarily changed depending upon the purpose in end use. Preferable mixing ratios of these ingredients are described.

The dye-receiving resin is preferably used in an amount of from 30 to 95 wt%, more preferably from 50 to 90 wt%, of the total solid composition in the dye-receiving layer. Within this range, the resultant dye-receiving sheet has appropriately good dye receptivity or printing sensitivity, weatherability and anti-blocking properties. If the content is less than 30 wt%, the weatherability tends to become slightly poor with a tendency toward the lowering of the dye receptivity. On the other hand, when the content exceeds 95 wt%, the heat resistance of the dye-receiving layer may, more or less, lower.

The mixture of the silane copolymer and colloidal silica is preferably used in an amount of from 5 to 70 wt%, more preferably from 10 to 50 wt%, of the total solid composition. As defined before, the colloidal silica is used in an amount of 1 to 200 parts by weight, preferably from 10 to 100 parts by weight, per 100 parts by weight of the silane copolymer.

The releasing agent is preferably used in an amount of from 0.1 to 20 wt%, preferably from 1 to 5 wt%, of the total solid composition in the dye-receiving layer.

The dye-receiving layer is preferably formed in a thickness of from 1 to 20 micrometers.

The dye-receiving layer may further comprise ingredients other than the essential ingredients, including, for example, UV absorbers, antioxidants and the like, if necessary.

The substrate of the dye-receiving sheet according to the invention is not limited to any specific ones and may be laminated synthetic papers, coated synthetic papers, transparent resin films, ordinary papers and the like sheets.

In accordance with a preferable embodiment of the invention, the dye-receiving sheet is fabricated in the following manner. An aqueous composition is prepared by mixing a dye-receiving resin which is soluble or is able to be dispersed in water, an aqueous dispersion of colloidal silica particles in an emulsion of a silica copolymer, and a water-soluble releasing agent by a suitable means. The composition is applied onto a substrate by any ordinary means and dried at a temperature of 50° to 150° C. During the application and drying, the emulsion breaks whereupon the silane copolymer and the colloidal silica are converted into network structures, in the resin matrix, through silane coupling of the emulsion particles of the copolymer per se and the emulsion particles and the silica particles. The network structures of the copolymer and the colloidal silica contribute to impart a high heat resistance to the dye-receiving layer. Because of the formation of the network structures in the layer, the dye-receiving resin may be used in high proportions, enabling the dye-receiving resin to form a substantially continuous phase in the layer. Accordingly when a sublimable dye is deposited on the dye-receiving layer, it can be stably received on and diffused into the layer. It will be noted that colloidal silica particles may be added to an emulsion of a silane copolymer during emulsification of the silane copolymer or after formation of the emulsion of the copolymer, thereby obtaining a silane copolymer dispersion of the colloidal silica particles.

The dye-receiving sheet obtained by the above process is advantageous in that during the drying, the releasing agent tends to segregate or gather in the surface of the dye-receiving layer. Accordingly, a relatively small amount of the releasing agent is sufficient for its releasing effect. In addition, when the sheet is heated at high temperatures, the releasing agent is likely to be diffused into the dry-receiving layer because of the presence of the strong network structures, not losing the releasing effect.

In the above process, although the aqueous composition is dried after coating, any specific curing step except for the drying is not necessary, leading to high productivity. The sheet obtained by the process is also advantageous in that since the aqueous composition is used, its pH of the resultant dye-receiving layer can be arbitrarily controlled. Some sublimable dyes will deteriorate in weatherability depending upon the pH of the dye-receiving layer. Especially, when the dye-receiving layer is acidic in pH, the weatherability deteriorates considerably if indoaniline dyes are used in the dye transfer layer of a dye transfer sheet. Accordingly, when the aqueous composition is controlled in pH to 7 or over, the resultant dye-receiving layer, which is alkaline in nature, exhibits good weatherability for a variety of sublimable dyes.

The aqueous composition may be coated by any known coating techniques including, for example, roll coating, spray coating, gravure coating, rod coating and the like.

As a matter of course, the dye-receiving resins, silane copolymers and colloidal silica particles, and the releasing agents described hereinbefore may all be used in the above fabrication process. Moreover, an aqueous composition is used in the above process, but a dye-receiving resin may be dissolved in a mixed solvent system of water and an organic solvent. Such a solvent should not break the silane copolymer emulsion and is generally used in an amount of several percent to 50% on the weight basis. Examples of the solvent include ethanol, isopropyl alcohol, ethyl cellosolve, butyl cellosolve and the like.

The present invention is more particularly described by way of examples.

EXAMPLE 1

An aqueous dispersion of the following formulation was applied onto a synthetic paper substrate (Yupo available from Ohji Yuka Synthetic Paper Co., Ltd.) in a wet thickness of about 5 micrometers by means of a wire bar and sufficiently dried at a temperature of 80° C. for 10 minutes to obtain a dye-receiving sheet.

| | |
|---|---|
| Dispersion of a saturated linear polyester resin (solid content of 34 wt %, Vyronal MD-1200, Toyobo Ltd.) | 66.6 parts by weight |
| Emulsion of a silane copolymer and colloidal silica (solid content of 43 wt %, Mowinyl 8020 available from Hoechst Gosei Co., Ltd.) | 31.6 parts by weight |
| Surface active agent (PEG-6000S, from Sanyo Kasei Ind. Co., Ltd.) | 1.8 parts by weight |

EXAMPLE 2

The general procedure of Example 1 was repeated except that the emulsion of the silane copolymer and colloidal silica and the surface active agent were replaced by the following emulsion and agent, thereby obtaining a dye-receiving sheet.

| | |
|---|---|
| Emulsion of a silane copolymer and colloidal silica (solid content of 31 wt %, copolymer/colloidal silica = 50/50 on the weight basis, VONCOAT DV-804, from Dainippon Ink Chem Co., Ltd.) | 43.8 parts by weight |
| Silicone surface active agent (NVS Silicone L-720, Nippon Unicar Co., Ltd.) | 1.8 parts by weight |

EXAMPLE 3

The general procedure of Example 1 was repeated except that 1.8 parts by weight of a fluorine-containing surface active agent (Megafac F-144D, from Dainippon Ink Chem. Co., Ltd.) was used, thereby obtaining a dye-receiving sheet.

COMPARATIVE EXAMPLE

An aqueous composition of the following formulation was applied onto a synthetic paper substrate (Yupo, available from Ohji Yuka Synthetic Paper Co., Ld.) in a wet thickness of about 5 micrometers by means of a wire bar and dried at a temperature of 80° C. for 10 minutes to obtain a dye-receiving sheet.

| | |
|---|---|
| Dispersion of a saturated linear polyester resin (solid content of 34 wt %, Vyronal MD-1200 available from Toyobo Ltd.) | 32 parts by weight |
| Low molecular weight polyethylene wax dispersion (solid content of 20 wt %, Permarine PN, from Sanyou Kasei Ind. Co., Ltd.) | 54 parts by weight |
| Colloidal silica sol (solid content of 40 w %, Snowtex 40 available from Nissan Chem Ind. Co., Ltd.) | 14 parts by weight |

EXAMPLE 4

The general procedure of Example 1 was repeated except that 66.6 parts by weight of the saturated linear polyester resin dispersion were changed to 58.6 parts by weight and ×31.6 parts by weight of the emulsion were changed to 37.9 parts by weight, thereby obtaining a dye-receiving sheet.

EXAMPLE 5

The general procedure of Example 1 was repeated except that 66.6 parts by weight of the saturated linear polyester resin dispersion were changed to 93.2 parts by weight and 31.6 parts by weight of the emulsion were changed to 10.5 parts by weight, thereby obtaining a dye-receiving sheet.

EXAMPLE 6

The general procedure of Example 1 was repeated except that 66.6 parts by weight of the saturated linear polyester resin dispersion were changed to 101.2 parts by weight and 31.6 parts by weight of the emulsion were changed to 4.2 parts by weight, thereby obtaining a dye-receiving sheet.

A dye transfer sheet was separately made in the following manner. A coating composition comprised of 12 parts by weight of an epoxy acrylate resin having a viscosity of 150 poises, 3 parts by weight of neopentyl glycol diacrylate, 0.75 parts by weight of 2-hydroxy-2-methylpropiophenone, 3.0 parts by weight of white carbon (Carplex PS-1 available from Shionogi Pharmaceutical Co., Ltd.), 0.15 parts by weight of silicone oil, 0.3 parts by weight of a surface active agent (L7500 available from Nippon Unicar Co., Ltd.) and 100 parts by weight of ethyl acetate was applied onto one side of a 6 micrometer thick polyethylene terephthalate film, followed by drying with hot air and curing by irradiation with a high pressure mercury lamp. A dye layer was formed on the other side of the film as follows. Four parts by weight of polysulfone and 2 parts by weight of a indoaniline sublimable dye of the following formula were dissolved in monochlorobenzene and applied onto the other side of the film in an amount of about 0.3 g/m$^2$, calculated as the dye, by means of a wire bar to form a dye transfer sheet.

Sublimable dye:

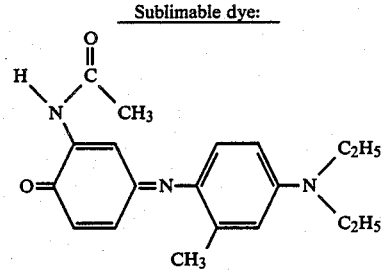

The dye-receiving sheets obtained in the examples and the comparative example were each superposed on the dye layer of the dye transfer sheet and subjected to thermal transfer printing under the following printing conditions. The resultant prints were subjected to measurements of printing characteristics including a printing density and a releasing property, and weatherability characteristics including a light fastness and a fastness in the dark of the print.

Printing Conditions:

Main and sub-scanning density: 4 dots/mm

Printing speed: 33.3 ms/line

Printing power: 0.7 W/dot

Printing pulse width: 0–8 ms.

The results are shown in the following table, in which ΔE indicates a color difference, expressed by the CIE L.a.b color specification system, after irradiation of xenone light ($2.0\times10^8$ J/m$^2$) and ΔD indicates a reduction rate of a printing density after allowing to stand under conditions of 60° C. and 60% R.H. for 10 hours. The color difference and the reduction rate are both values at a printing pulse width of 8 ms. The weight ratio indicates a weight ratio by percent of a dye-receiving resin to the total solids in the dye-receiving layer.

TABLE

| | Printing Density | Releasability | ΔE | ΔD | Weight Ratio |
|---|---|---|---|---|---|
| Example | | | | | |
| 1 | 2.10 | o | 17 | — | 60 |
| 2 | 2.05 | o | 14 | — | 60 |
| 3 | 2.12 | o | 15 | 5 | 60 |
| 4 | 2.05 | o | 15 | — | 52 |
| 5 | 2.10 | o | 13 | — | 83 |
| 6 | 2.08 | Δ (slightly sticky) | 12 | — | 91 |
| Comp. Ex. | 1.73 | o | 25 | — | 25 |

As will be apparent from the above results, the printing densities of the sheets of the invention is significantly higher than those of the sheet for comparison. This true of the color difference. When the dye-receiving resin is contained in an amount of from 50 to 90 wt%, very good results are obtained, but the sheet of Example 6, for instance, may be used without any troubles when appropriate printing conditions are employed.

What is claimed is:

1. In a dye-receiving sheet for thermal transfer printing which is used in combination with a dye transfer sheet having a sublimable dye layer and which comprises a substrate and a dye-receiving layer formed on the substrate and comprised of a dye-receiving resin and a releasing agent, the improvment characterized in that said dye-receiving layer further comprises a mixture of a silane copolymer and colloidal silica particles, which is dispersed in said dye-receiving layer in the form of a silane-coupled product having network structures of the silane copolymer and the colloidal silica particles.

2. A dye-receiving sheet according to claim 1, wherein said dye-receiving layer comprises from 30 to 95 wt% of the dye-receiving resin, from 5 to 70 wt% of the mixture, and from 0.1 to 20 wt% of the releasing agent.

3. A dye-receiving sheet according to claim 1, wherein said dye-receiving resin is a saturated linear polyester resin.

4. A dye-receiving sheet according to claim 1, wherein said dye-receiving resin is contained in an amount of from 50 to 90 wt%.

5. A dye-receiving sheet according to claim 1, wherein said mixture is contained in an amount of from 10 to 50 wt%.

6. A dye-receiving sheet according to claim 1, wherein the silane copolymer is a copolymer of a silane monomer and at least one acrylic monomer in which the silane monomer is used in an amount of from 1 to 10 parts by weight per 100 parts by weight of the at least one acrylic monomer.

7. A dye-receiving sheet according to claim 1, wherein the colloidal silica particles are used in an amount of from 1 to 200 parts by weight per 100 parts by weight of the silane copolymer.

8. A dye-receiving sheet according to claim 1, wherein said agent is a silicone surface active agent having dimethylsilicone units and polyether units.

9. A dye-receiving sheet according to claim 1, wherein said agent is a fluorine-containing surface active agent having perfluoroalkyl groups and polyether units.

10. A dye-receiving sheet according to claim 1, wherein said releasing agent is contained in an amount of from 1 to 5 wt%.

11. A dye-receiving sheet according to claim 10, wherein said dye-receiving resin is a saturated linear polyester resin.

12. A dye-receiving sheet according to claim 10, wherein said dye-receiving resin is contained in an amount of from 30 to 95 wt%.

13. A dye-receiving sheet according to claim 10, wherein said mixture is contained in an amount of from 5 to 70 wt%.

14. A dye-receiving sheet according to claim 10, wherein the silane copolymer is a copolymer of a silane monomer and at least one acrylic monomer in which the silane monomer is used in an amount of from 1 to 10 parts by weight per 100 parts by weight of the at least one acrylic monomer.

15. A dye-receiving sheet according to claim 10, wherein the colloidal silica particles are used in an amount of from 1 to 200 parts by weight per 100 parts by weight of the silane copolymer.

16. A dye-receiving sheet according to claim 10, wherein said releasing agent is a silicone surface active agent having dimethylsilicone units and polyether units.

17. A dye-receiving sheet according to claim 10, wherein said releasing agent is a fluorine-containing surface active agent having perfluoroalkyl groups and polyether units.

18. A dye-receiving sheet according to claim 10, wherein said releasing agent is contained in an amount of from 1 to 5 wt%.

19. A dye-receiving sheet according to claim 10, wherein said aqueous composition has a pH not less than 7.

20. A dye-receiving sheet which is used in combination with a dye transfer sheet and is obtained by a process which comprises providing an aqueous composition comprising a dye-receiving resin which is soluble or dispersable in water, an aqueous dispersion of a colloidal silica particles in an emulsion of a silane copolymer, and a releasing agent soluble in water, applying the aqueous composition onto a substrate, and drying the applied composition to form a dye-receiving layer whereupon the emulsion breaks and silane coupling takes place between the emulsion particles of the silane copolymer and between the emulsion particles and the colloidal silica particles thereby forming strong network structures in the dye-receiving layer.

* * * * *